US005720410A

United States Patent [19]

Umiker

[11] Patent Number: 5,720,410

[45] Date of Patent: Feb. 24, 1998

[54] RETURNABLE PACK

[75] Inventor: Hans Umiker, Egg/ZH, Switzerland

[73] Assignee: Schoeller-Plast SA, Switzerland

[21] Appl. No.: 545,542

[22] Filed: Oct. 19, 1995

Related U.S. Application Data

[63] Continuation of Ser. No. 273,400, Jul. 11, 1994, abandoned, which is a continuation of Ser. No. 915,709, filed as PCT/EP91/02248, Nov. 27, 1991, abandoned.

[30] Foreign Application Priority Data

| | | | |
|---|---|---|---|
| Nov. 27, 1990 | [DE] | Germany | 40 37 696.6 |
| May 15, 1991 | [DE] | Germany | 41 15 893.8 |

[51] Int. Cl.[6] ..... B65D 6/22

[52] U.S. Cl. ..... 220/4.26; 220/6; 220/4.29

[58] Field of Search ..... 220/6, 4.28, 4.29, 220/4.26, 23.83, 23.86, 326, 324, 672, 608; 206/600

[56] References Cited

U.S. PATENT DOCUMENTS

| | | | |
|---|---|---|---|
| 827,124 | 7/1906 | Speer . | |
| 900,166 | 10/1908 | Harry . | |
| 2,364,007 | 11/1944 | Stanton | 220/4.26 |
| 3,908,852 | 9/1975 | Ricobene et al. | 206/550 |
| 4,167,232 | 9/1979 | Munk et al. | 206/509 |
| 4,203,525 | 5/1980 | Okubo | 220/4.26 |
| 4,347,941 | 9/1982 | Johansson et al. | 220/6 |
| 4,491,231 | 1/1985 | Heggeland et al. | 220/6 |
| 4,643,314 | 2/1987 | Kidd | 206/600 |
| 4,673,087 | 6/1987 | Webb | 206/600 |
| 4,765,252 | 8/1988 | Shuert | 108/55.1 |
| 4,828,132 | 5/1989 | Francis, Jr. et al. | 220/6 |
| 4,917,255 | 4/1990 | Foy et al. | 220/4.28 |
| 5,005,722 | 4/1991 | Roth | 220/404 |

FOREIGN PATENT DOCUMENTS

| | | | |
|---|---|---|---|
| 2190682 | 2/1974 | France . | |
| 2654703 | 5/1991 | France | 206/600 |
| 2693432 | 1/1994 | France | 206/600 |
| 1671256 | 8/1991 | U.S.S.R. . | |
| 2033874 | 5/1980 | United Kingdom . | |
| 2046217 | 11/1980 | United Kingdom . | |
| 2086351 | 5/1982 | United Kingdom | 206/600 |

*Primary Examiner*—Stephen J. Castellano

*Attorney, Agent, or Firm*—Price, Heneveld, Cooper, Dewitt & Litton

[57] ABSTRACT

A returnable container is provided which may be molded or otherwise formed from plastic and is configured to accept objects. The container is preferably assembled from matching elements as modular building blocks. The building blocks used to form the container are made from two different shapes.

3 Claims, 15 Drawing Sheets

RETURNABLE PACK

CROSS-REFERENCE TO RELATED CASE

Figure 1:
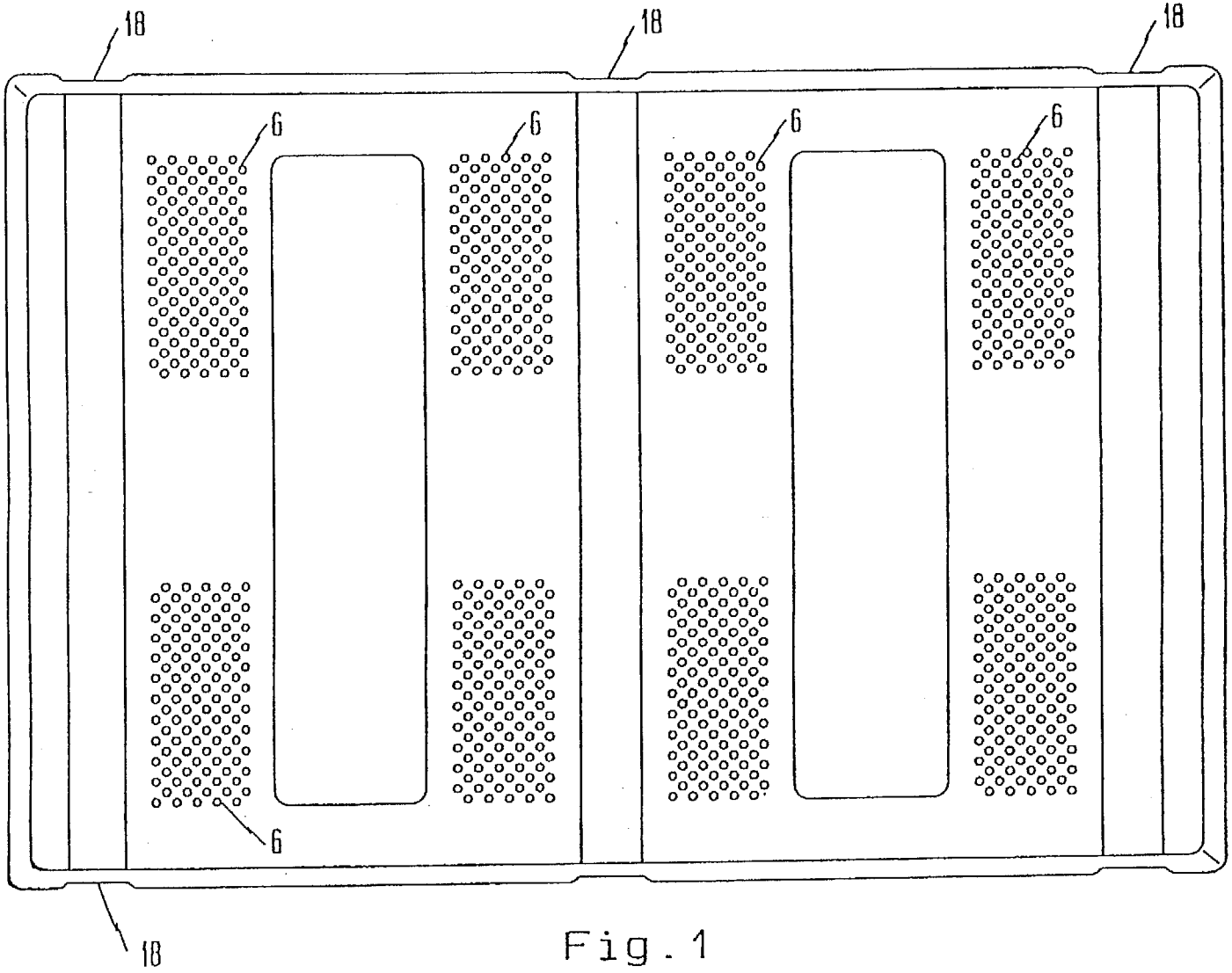

This is a continuation of application Ser. No. 08/273,400 filed Jul. 11, 1994, now abandoned, for RETURNABLE PACK, which is a continuation of application Ser. No. 07/915,709, filed as PCT/EP91/02248 Nov. 27, 1991, now abandoned.

The invention concerns a returnable pack, in particular a container for use in such returnable packaging system.

The increasing emphasis on the protection of the environment and the accompanying resulting demands for decreased waste or far-reaching waste avoidance leads to considerable difficulties in the case of conventional packaging systems, since according to planned ordinances or ordinances which have already been passed in certain countries, transport packs must, after use, be taken back by the wholesale and retail trade and disposed of outside of the public disposal services for re-use or recycling. In the case of conventional one-way cardboard packs, which are often used in conjunction with shrink wrap and adhesive tapes, this involves for the business or service organization responsible for disposal of the packaging material a sorting and storage expense, which necessarily results in conventional packaging systems becoming more expensive.

In order to eliminate these problems, concepts for returnable packaging systems have already been proposed, which in practice could not be implemented, however, at the trade or consumer level for a number of different reasons.

A packaging system has already been proposed which consists of box-like containers of recyclable plastic, the side panels of which are of conical construction for the purpose of stacking the empty containers. Apart from the fact that because of the conical construction of the container side panels a fairly sizable dead volume is created that cannot be used for packaging or for accommodating shippable products, the conical construction often causes the stacked containers to jam during the return transport, which also carries with it the danger that when separating the stacked containers they can be damaged or destroyed. Moreover, in the case of these containers, the merchandise packed in them must be unpacked by sales personnel and shifted to shelves.

Finally, it is known how to construct a container from collapsible elements, which again requires, however, that for display purposes the goods must be taken out of the container and put on the shelf. Furthermore, a fairly considerable weakening of the container results from the large number of joint hinges used for this solution, so that the use of this container system for transport and packaging of comparably light products is limited. The frequently collapsible construction of these systems entails that this type of pack is only reluctantly being accepted by the trade and the consumer, whereby especially manufacturers of high-value quality goods mostly reject these systems, because they are concerned that the pack's defects are going to be identified with their own products.

The object of the invention is to create a returnable pack, of rugged construction, easy to manufacture, for multiple applications as well as easy to handle. Furthermore, the pack should have product-displaying characteristics and enable a considerable volume reduction for the return trip when empty. Finally, the pack should be suitable for palletizing systems, well stackable and in stacked condition also combinable with other conventional packaging systems.

This objective is individually and in combination solved by means of the characteristics set forth in the claims or in the description hereinafter.

The container according to the invention is a box consisting of matching elements, of bottom, cover and the side panels of the container or box which form the wall panels. Bottom and cover are suitably uniform, i.e. the bottom can at the same time be used cover and vice versa.

In effect, bottom and cover are designed in the form of a tray and consist specifically of a plate-shaped bottom element with a all-around wall molding of reduced height. The individual elements can preferably be assembled via plug-in connections into the container, whereby the wall panel is then mounted onto the bottom and subsequently the cover onto the wall panel. This makes it possible to use the pack also immediately for product display, since only the cover and/or the wall panel needs to be lifted up and off for the goods to be shifted to the shelf together with the bottom element. Because of this, there is no longer the need for sales personnel to unpack and shift the goods to the shelf as is the case with the conventional packaging systems. The system is purposely of modular construction, whereby bottom and cover are combinable, i.e. also without wall panel, bottom and cover it forms a container accommodating cans.

The collapsible construction of the wall panel is particularly advantageous, since this enables a considerable volume reduction for the return trip. Bottom and cover are suitably stackable into each other for the return trip. To this effect, it is useful to provide for hinges in the corner areas and/or in the middle of the panel sides, so that the panel can be folded together to one size, which enables accommodation of the folded panel within the container itself or that the folded panel, because of its dimensions, does not project beyond the basic dimensions of the other container elements.

Recessed grips in bottom and cover not only facilitate the handling, but they form open slots for the closed container for ventilation and cooling purposes.

Using knobs (=protuberances), especially arranged in fields, on predetermined bottom and cover surfaces, makes stacking of the containers slip-free to a large degree thereby avoiding stacking borders which are frequently used with conventional packaging; this in turn creates the advantage of being able to use the pack according to the invention in combination with conventional packaging systems, especially cardboard packs. The wall panel can be suitably designed with display openings, which may be formed by a transparent wall of the wall panel. The individual elements making up the container are suitably affixed by means of conventional tightening straps which may be soldered, whereby other affixing possibilities are also realizable, such as push button systems. The tightening straps and other fasteners from the same material are thereby suitably manufactured like the individual elements of the container, that is to say, preferably from polypropylene, which permits a simple recycling. Polypropylene has shown itself to be a suitable material for this purpose, since the containers will in that case have a useful life of more than ten years.

The invention guarantees that with a few system components a universally usable returnable pack is obtained. Thus, containers consisting of only one bottom and one cover can be produced e.g., whereby the container height may be changed at random by adding one or several wall panels. Depending on the type of goods, the pack can also be produced by using only one bottom or by using only one bottom and one cover, that is to say without side walls, in which case the goods are affixed to the bottom and/or cover by means of tightening straps. If no tightening straps are used, the container elements can also be secured by means of labels glued on the outside.

The box is therefore very well suitable for transporting goods; yet is equally suitable for displaying goods on the shelf. A space-saving return trip of the box is possible at the same time. Because of its modular construction, one and the same box may be used for many different products. Because of the versatile applicability of this packaging system preferably consisting of only two system components, namely tray or dish-shaped or plate-shaped bottom element for bottom and cover as well as panels for the side walls forms a solution for the earlier-explained problem, which is now being adopted by the trade and the consumer.

Figure 2:
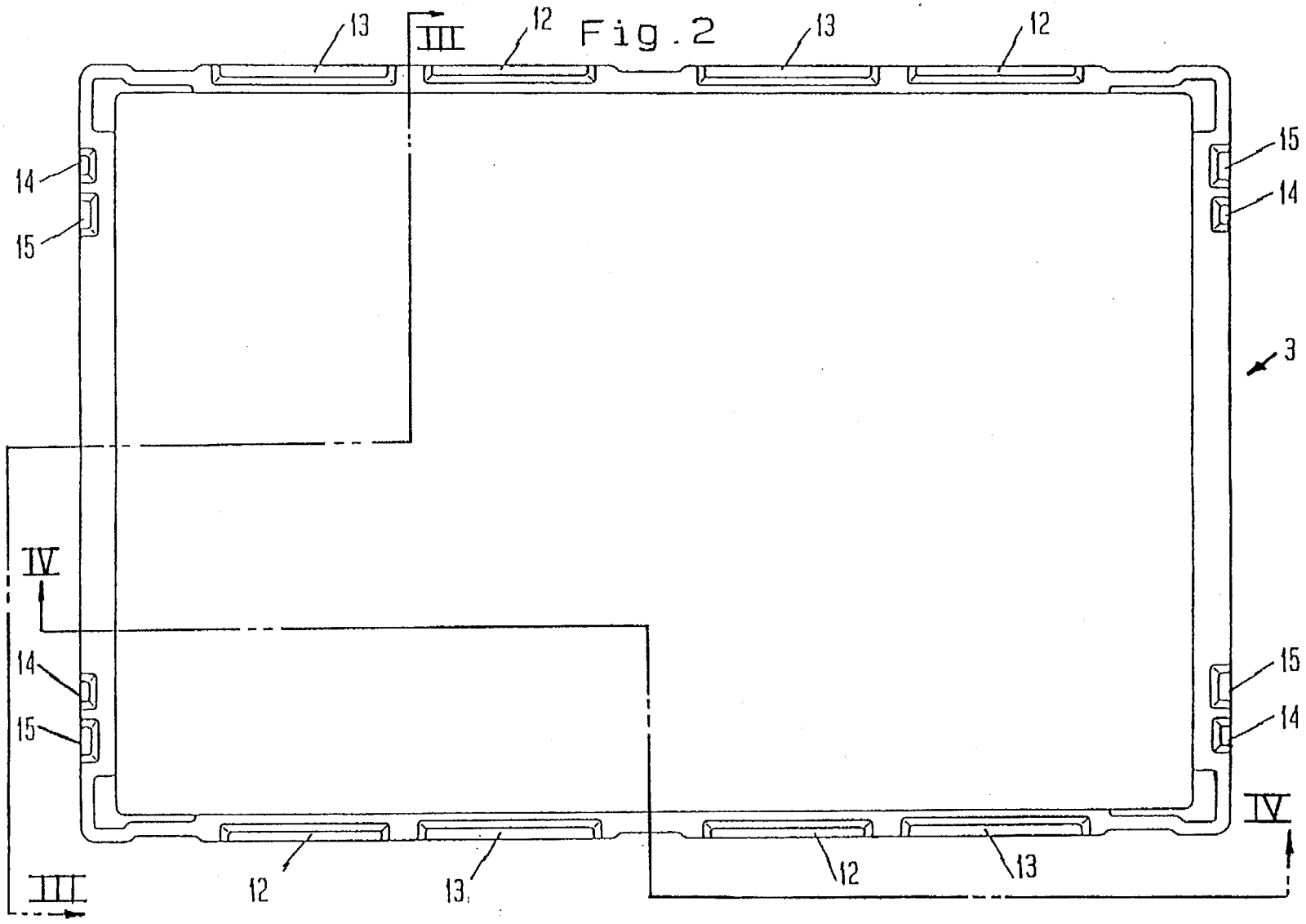
Figure 3:
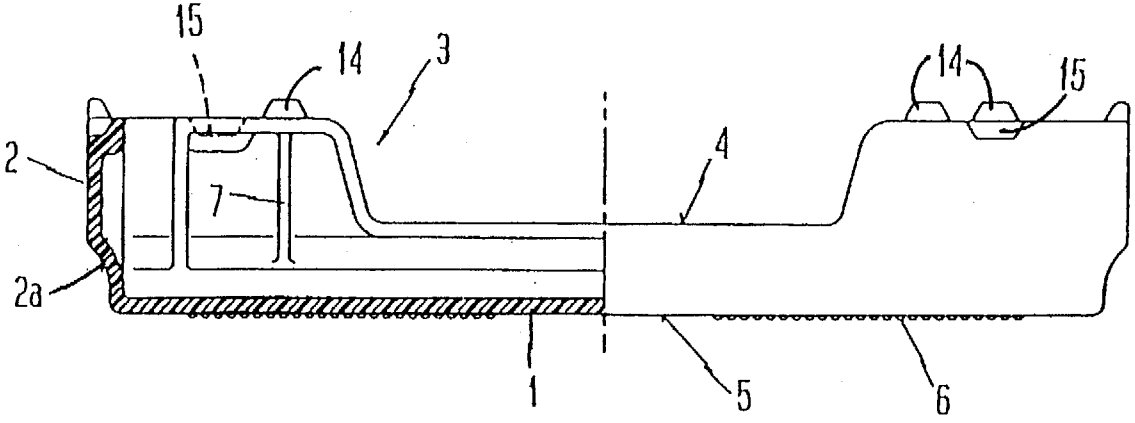
Figure 4:
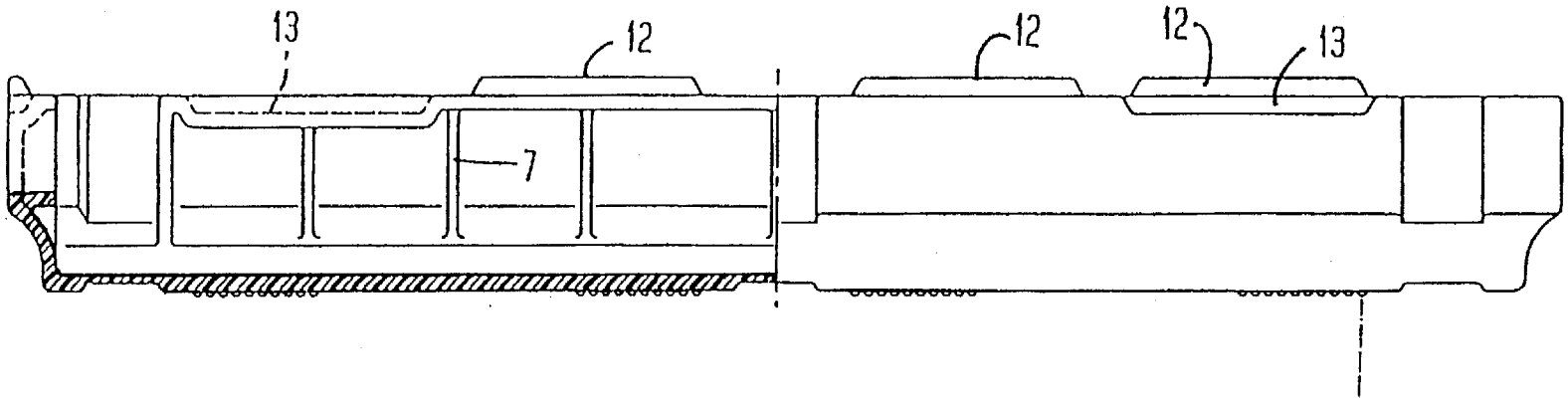
Figure 5:
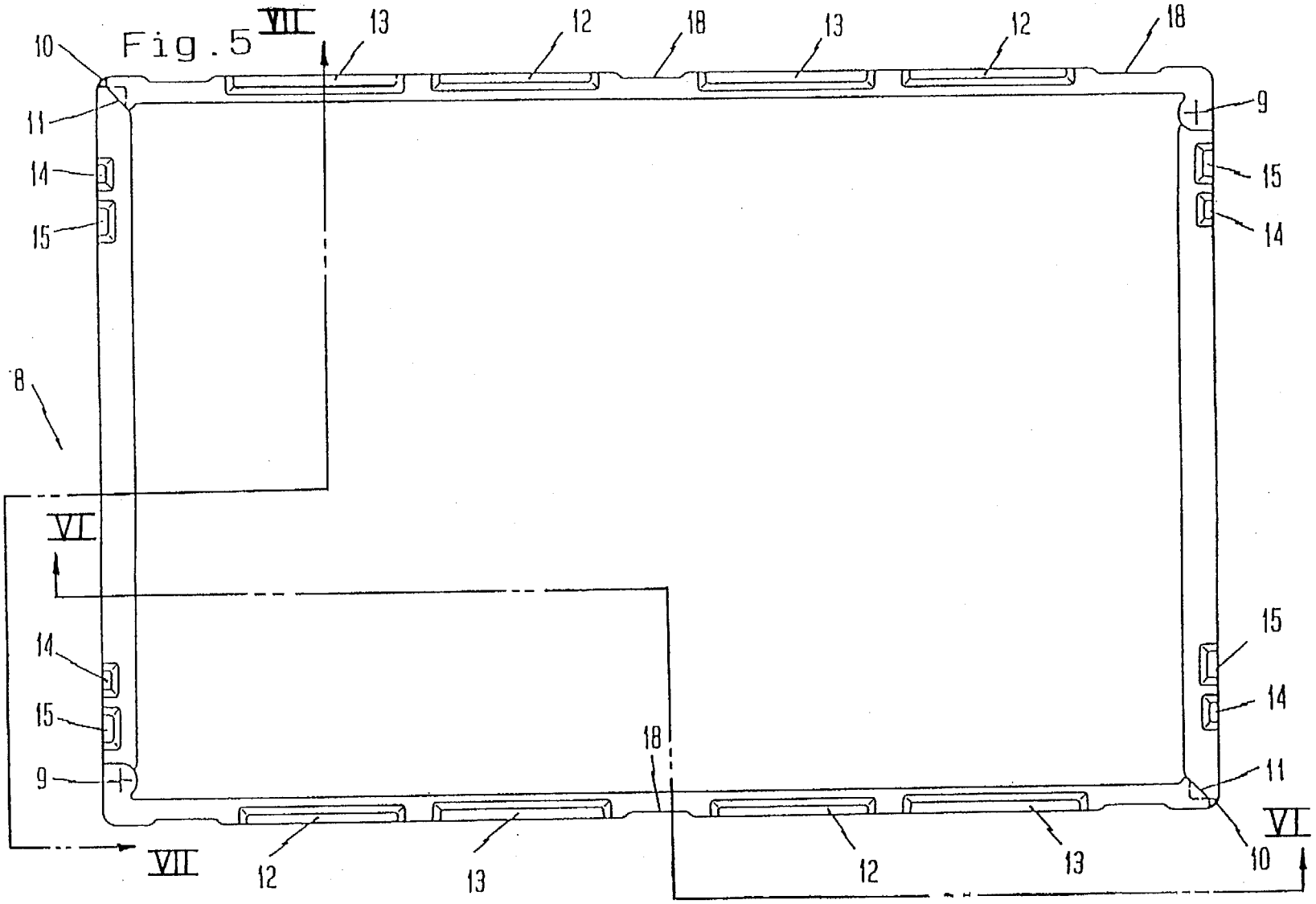
Figure 6:
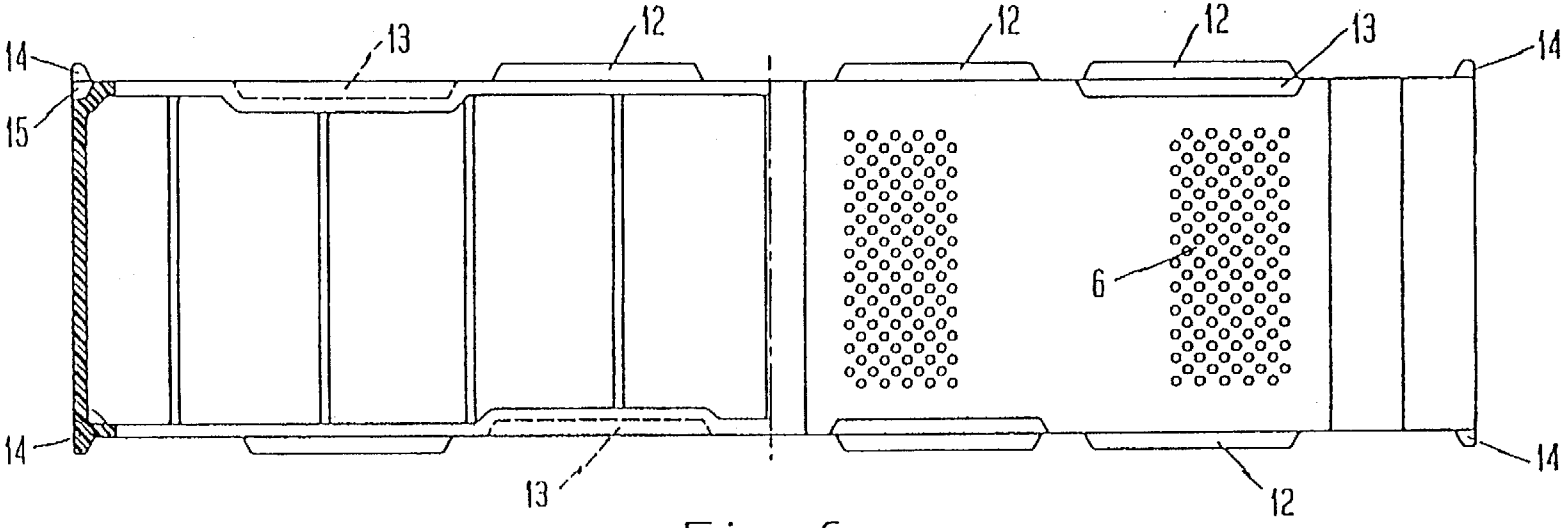
Figure 7:
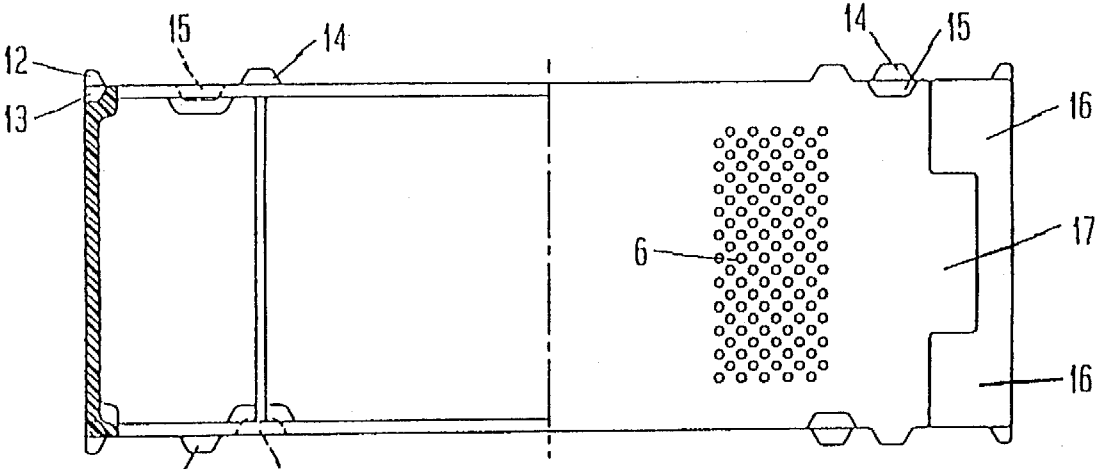
Figure 8:
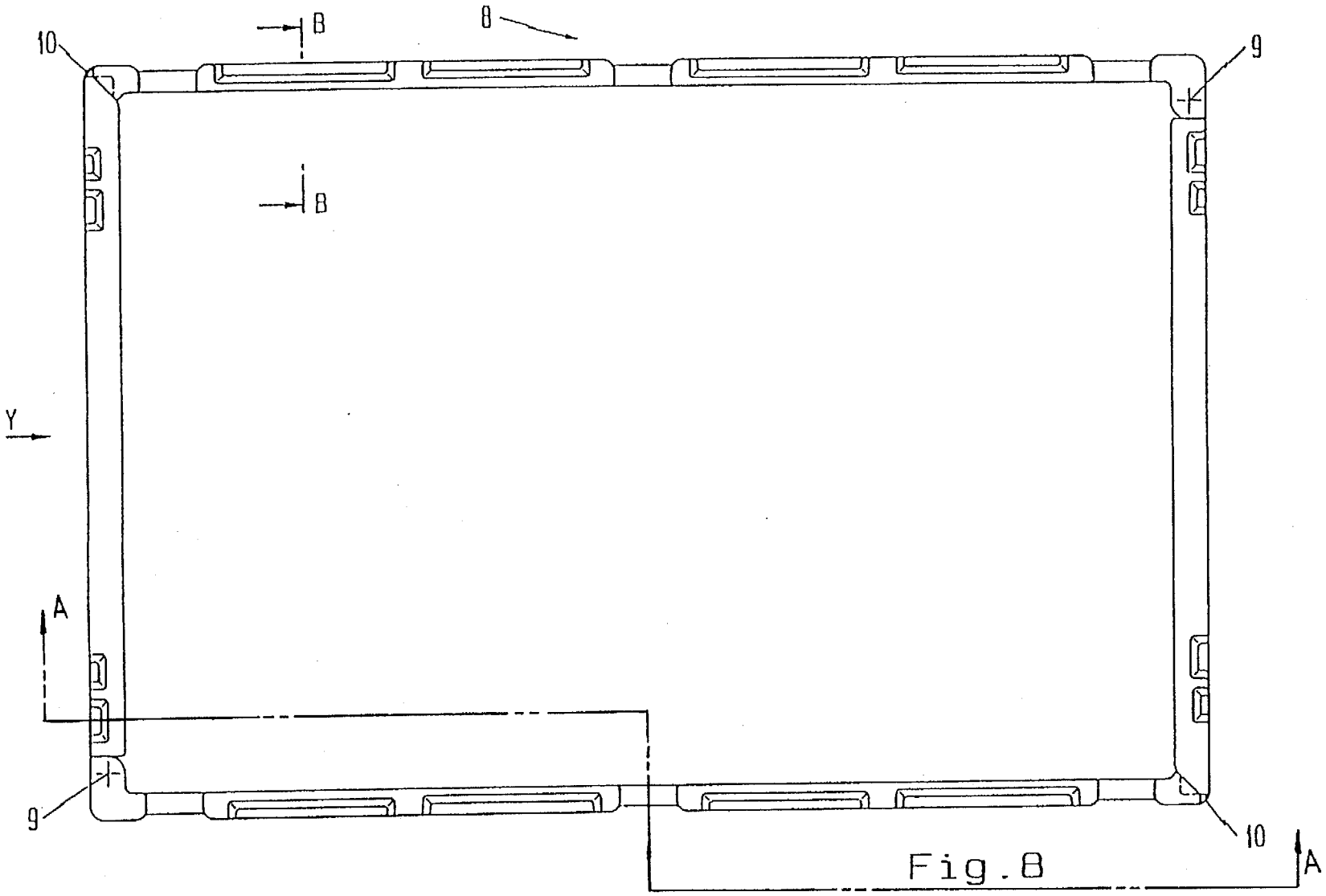
Figure 10:
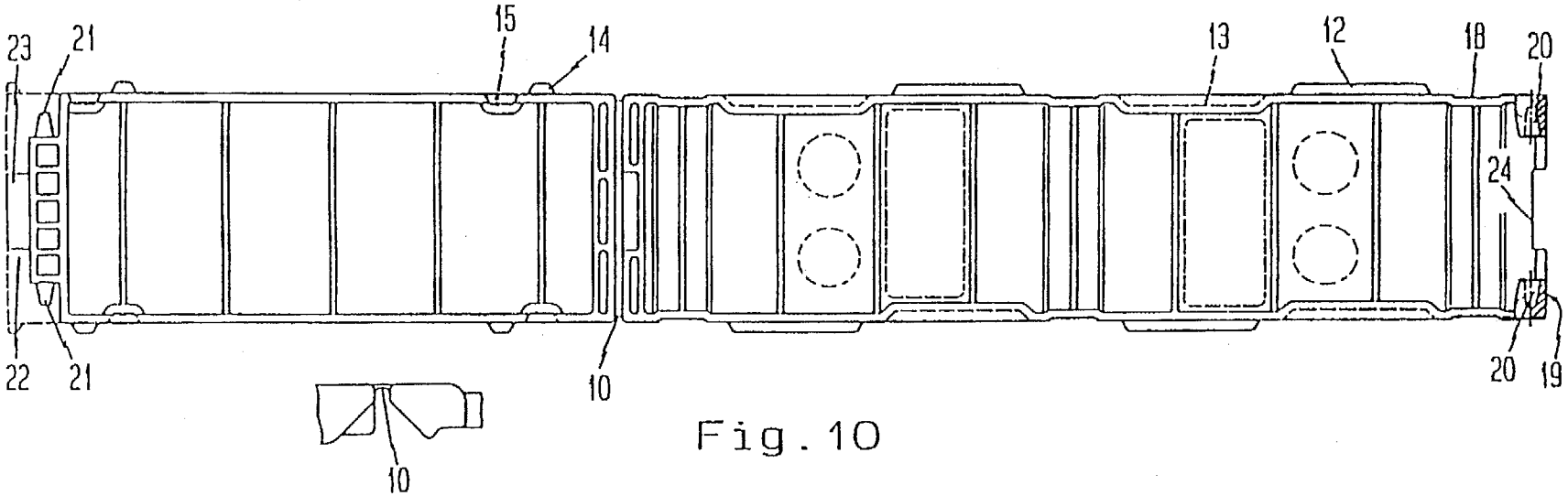
Figure 9:
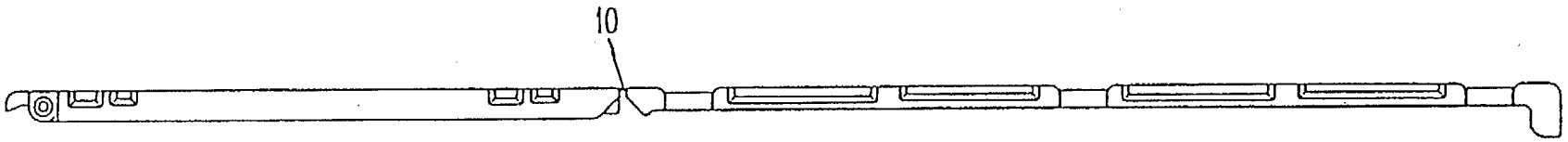
Figures 11, 13:
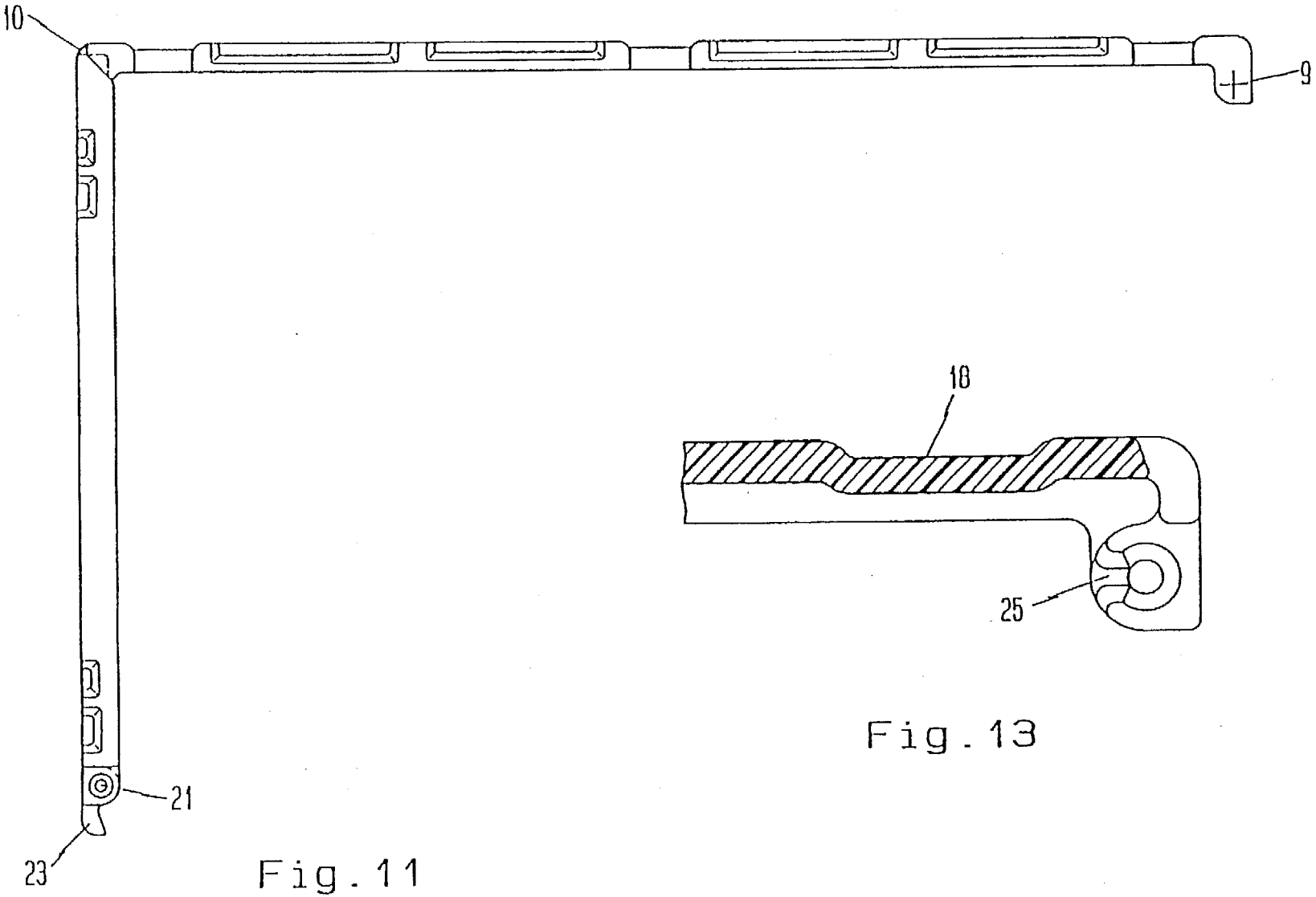
Figure 12:
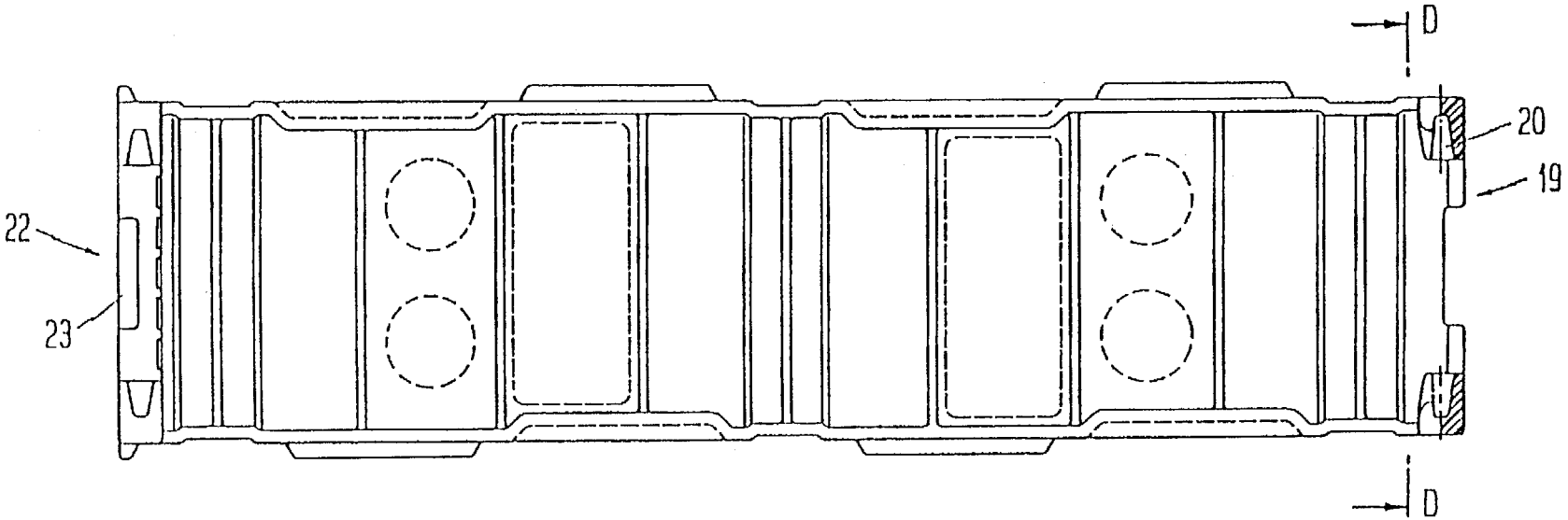
Figure 14:
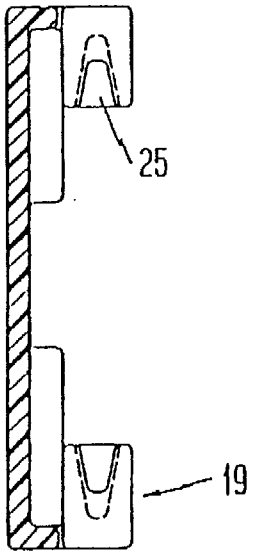
Figure 15:
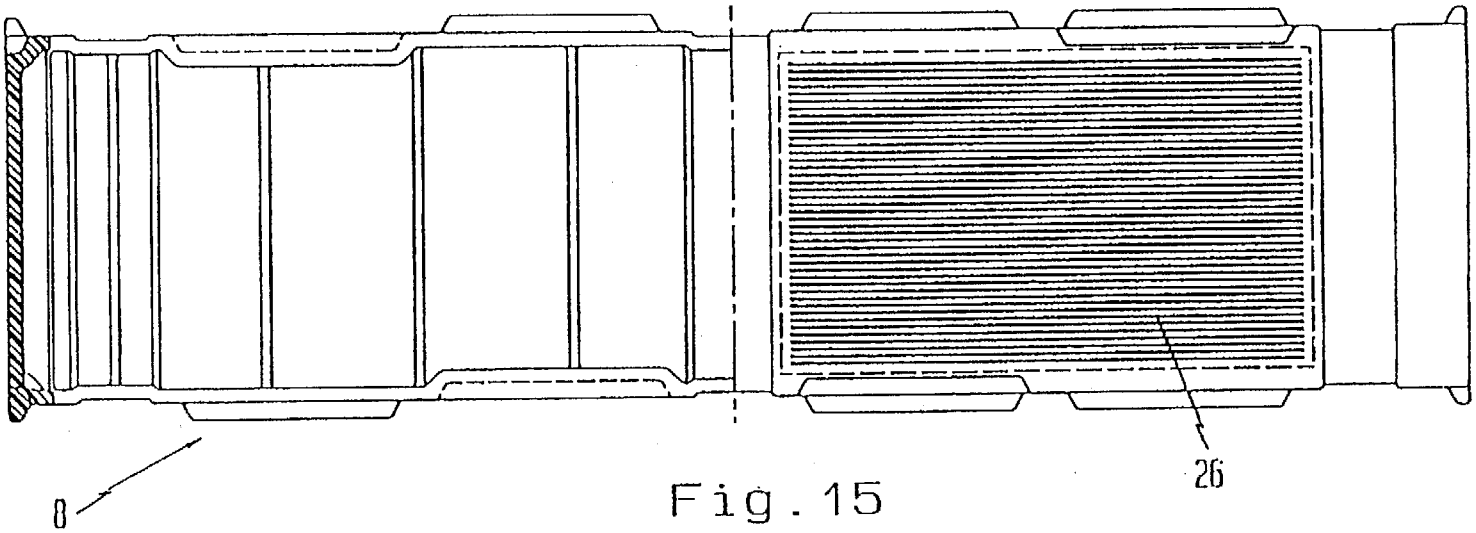
Figure 17:
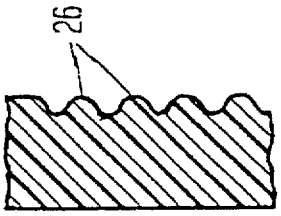
Figure 16:
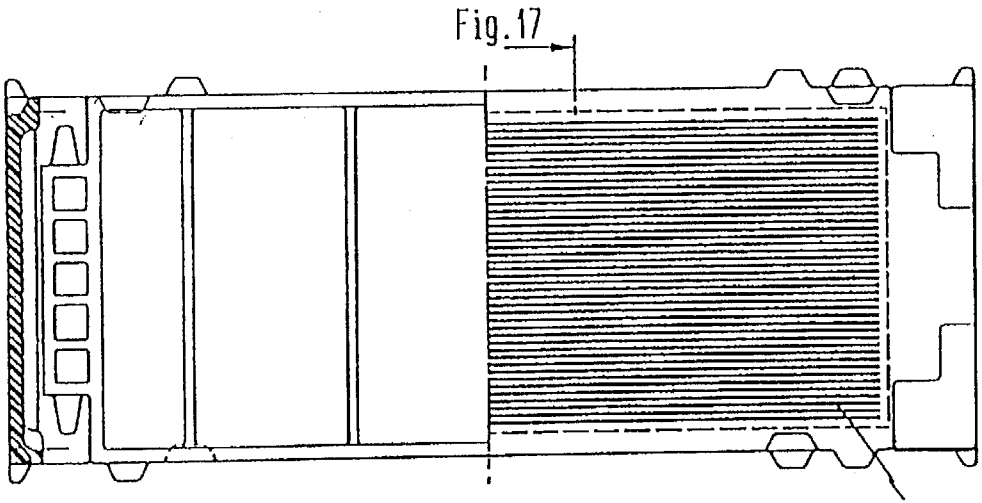
Figure 18:
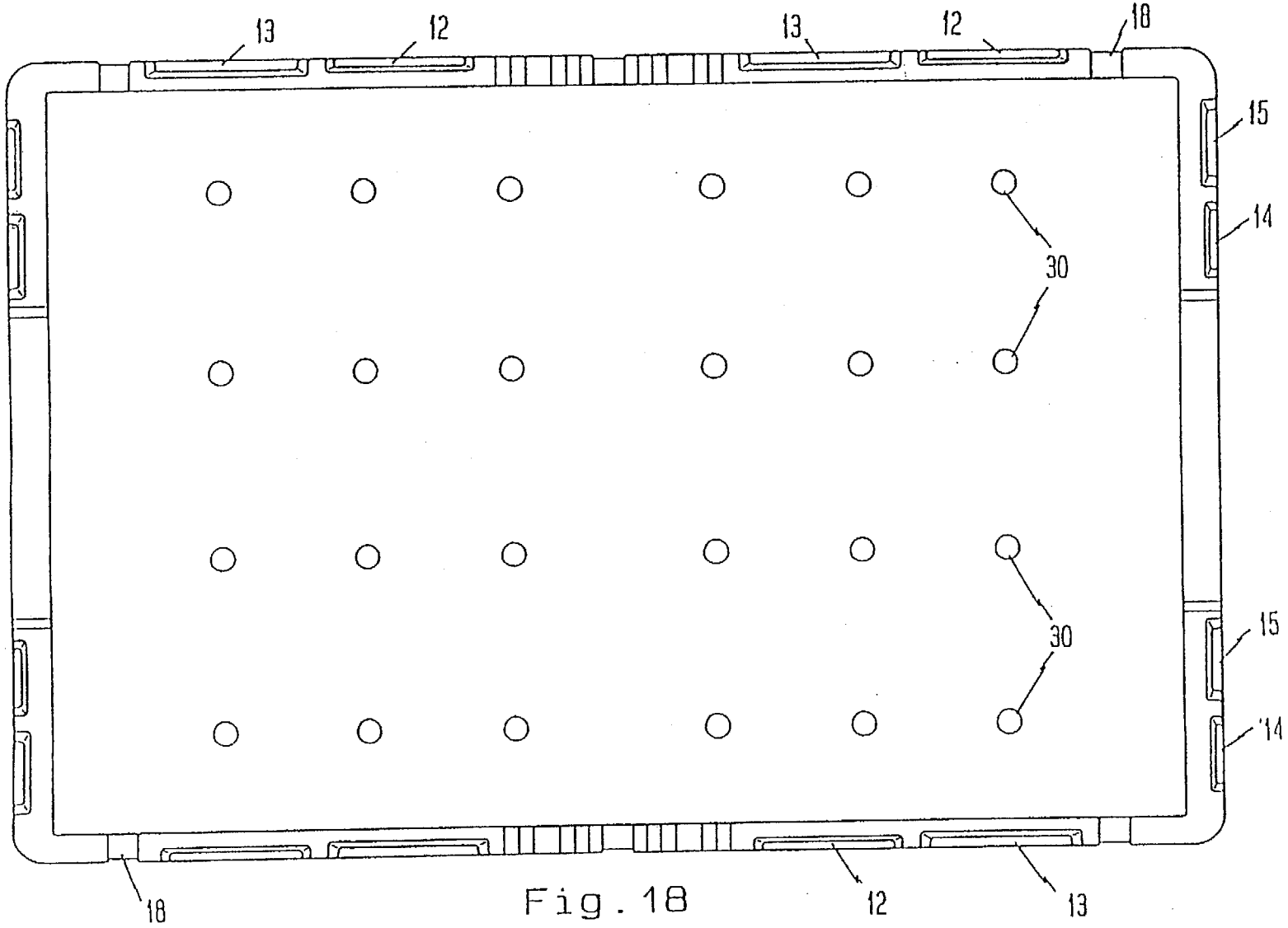
Figure 19:
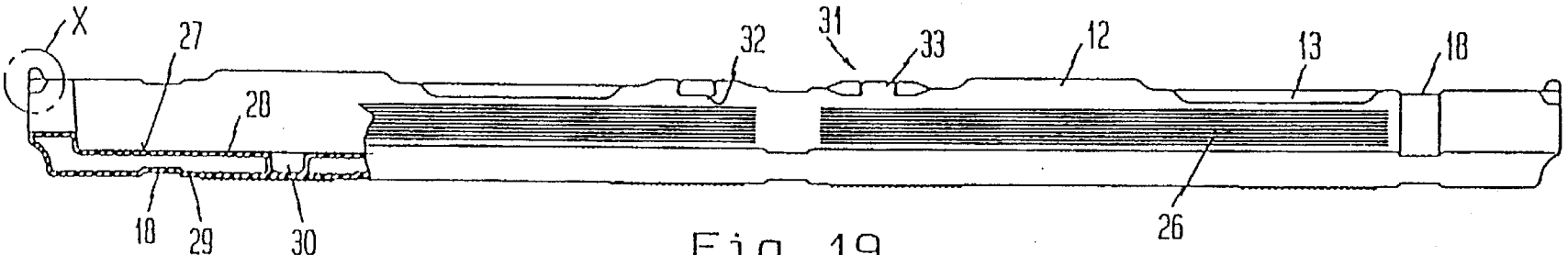

Below, the most important characteristics of the invention are highlighted using a description of a preferred embodiment. The drawings show the following:

FIG. 1 a view of the bottom element of the container from below,

FIG. 2 a top view of the bottom element according to FIG. 1,

FIG. 3 a partial sectional and partial side elevational view of the bottom element, seen from the narrow side, FIG. 4 a partial longitudinal sectional and partial side elevational view of the bottom element, FIG. 5 a top view of one wall panel of the container, FIG. 6 a side view of the wall panel according to FIG. 5, whereby the left half is a sectional representation, FIG. 7 a sectional view of the wall panel, cut-away in one half, seen from the narrow side, FIG. 8 a top view of a further embodiment of a wall panel, FIG. 9 a top view of a partial element of the wall panel according to FIG. 8, FIG. 10 a side view of the partial element shown in FIG. 9, FIG. 11 a top view of the partial element shown in FIG. 9, in collapsible position, FIG. 12 a side view of the partial element shown in FIG. 11, FIG. 13 a sectional view along Line C—C in FIG. 10, FIG. 14 a sectional view along Line D—D of FIG. 12, FIG. 15 a partial sectional and partial side elevational view of the wall panel shown in FIG. 8 (Section along Line A—A, View according to Arrow Z), FIG. 16 a sectional view along Line B—B as well as a partial view according to Arrow Y as per FIG. 8, FIG. 17 a sectional View of a detail in FIG. 16, FIG. 18 a top view of a further embodiment of a bottom/cover, FIG. 19 a partial sectional side view of the cover in FIG. 18

Figure 20:
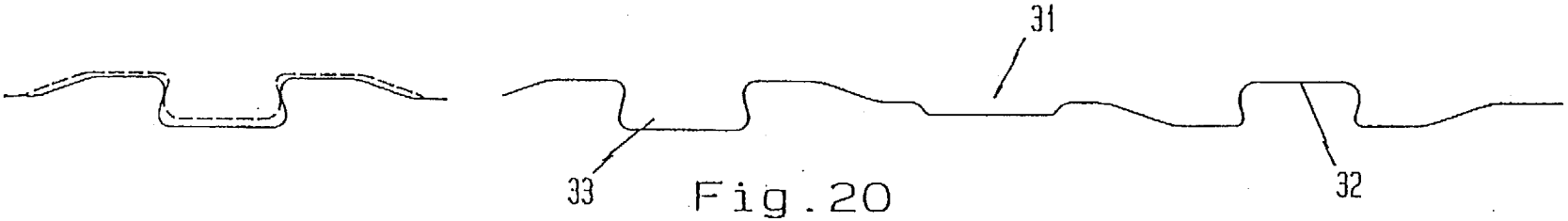
Figure 21:
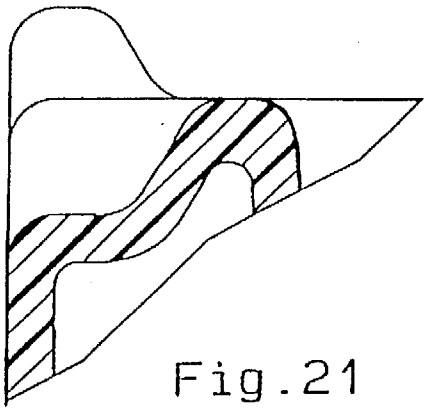
Figure 22:
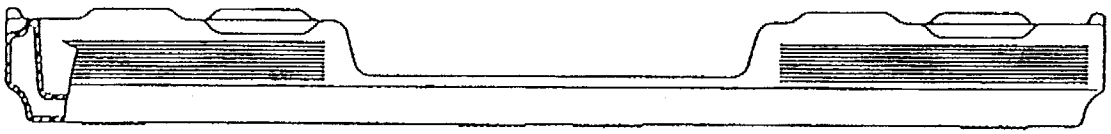
Figure 23:
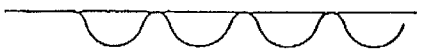
Figure 24:
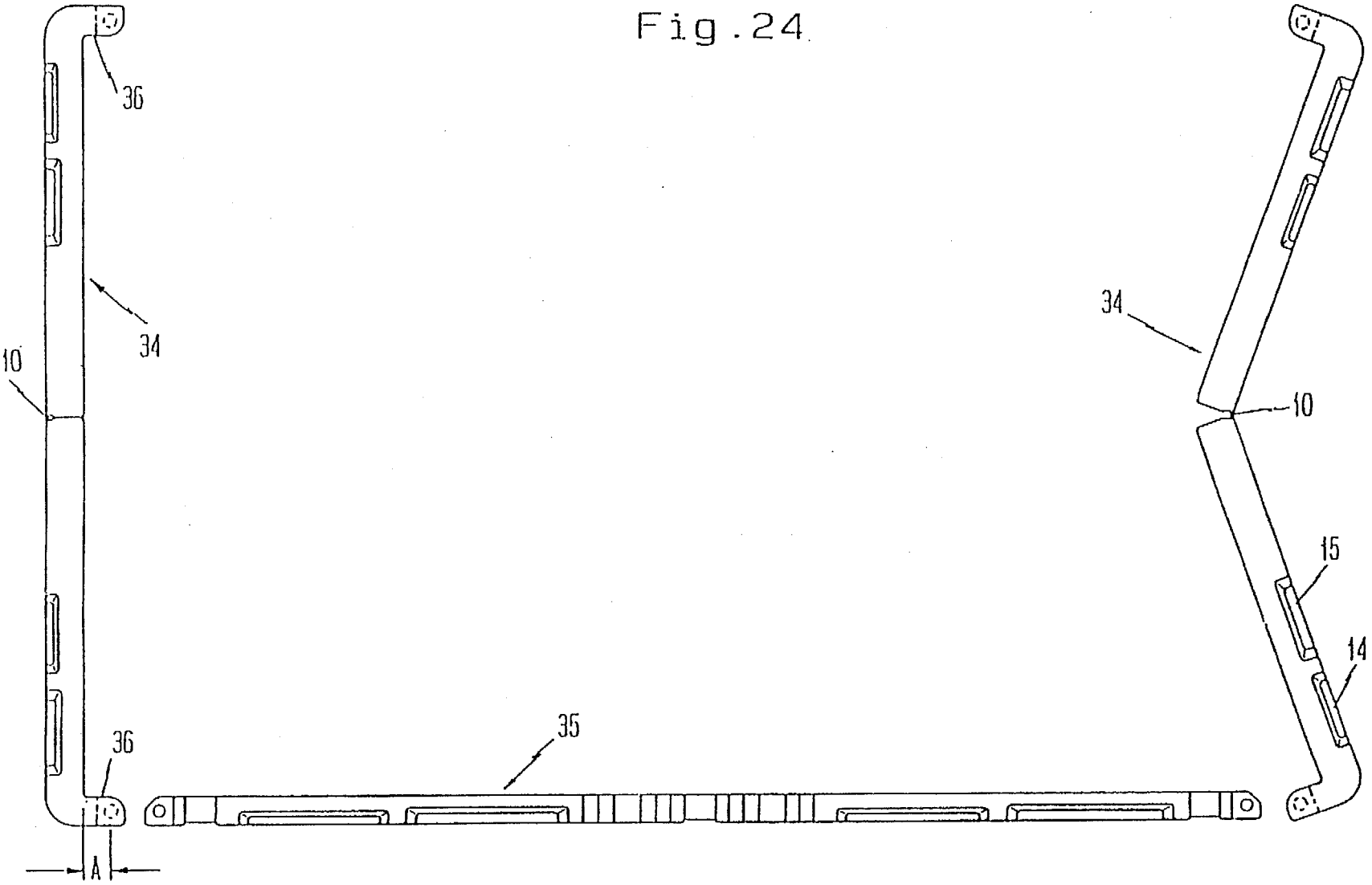
Figure 25:
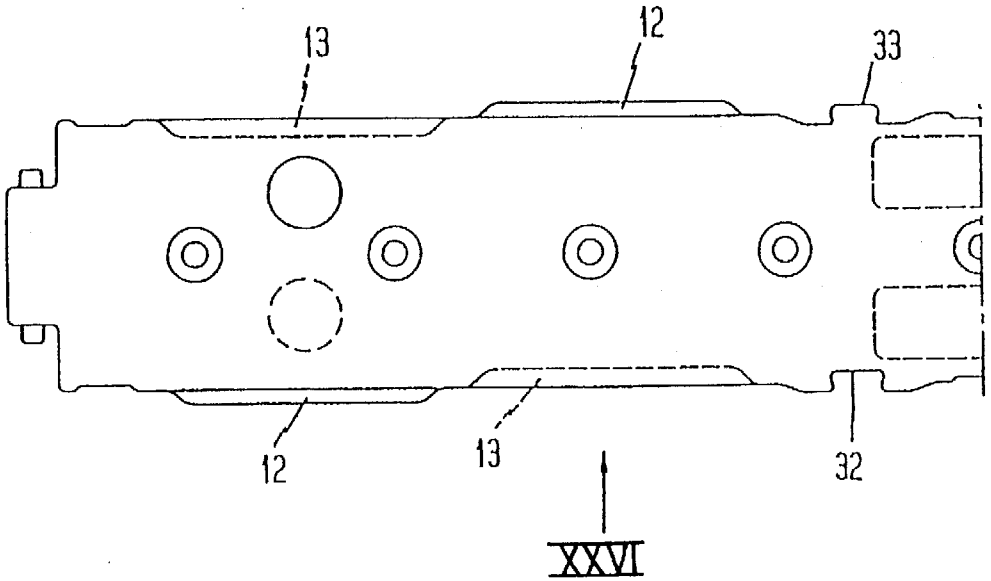
Figure 26:
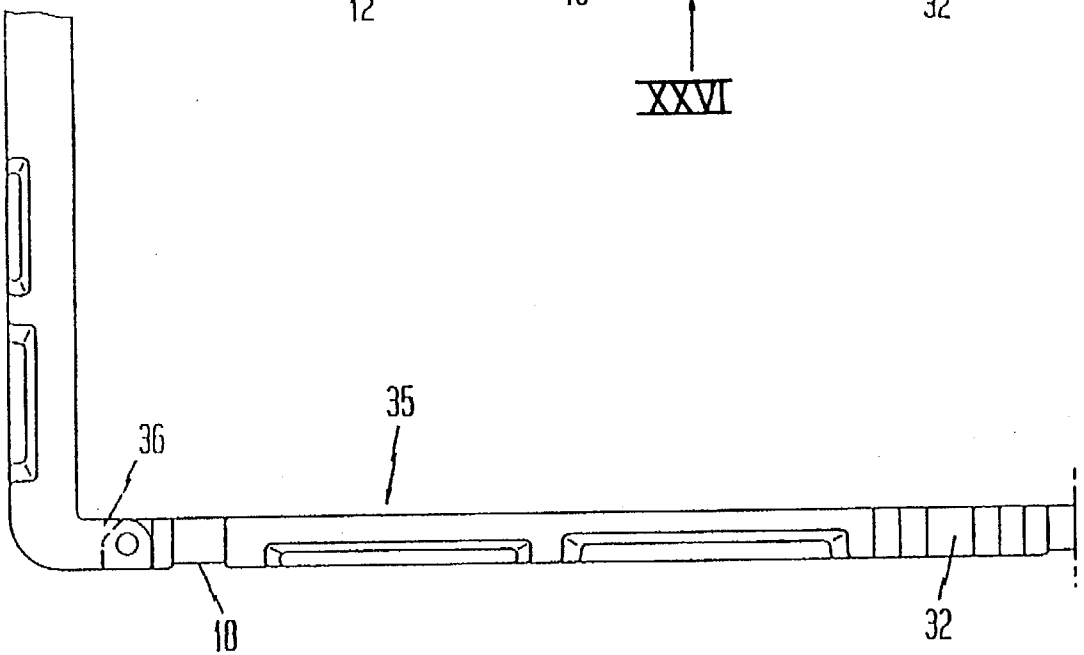
Figure 27:
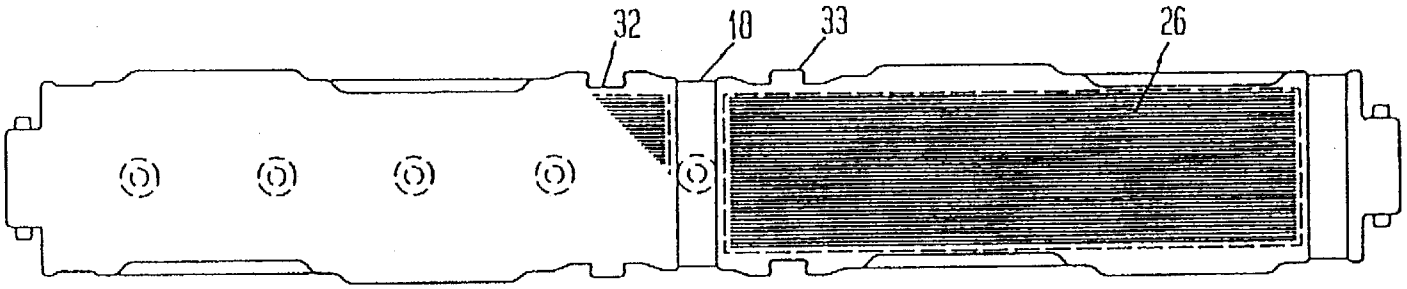
Figure 30:
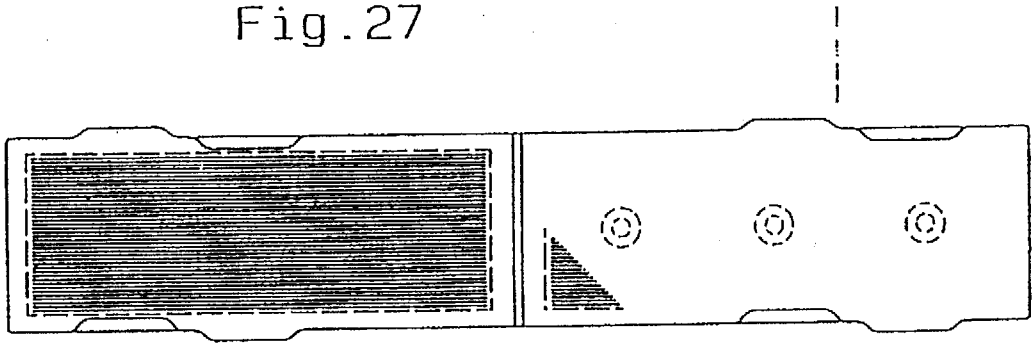
Figure 28:
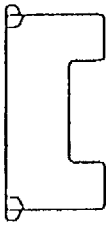
Figure 29:
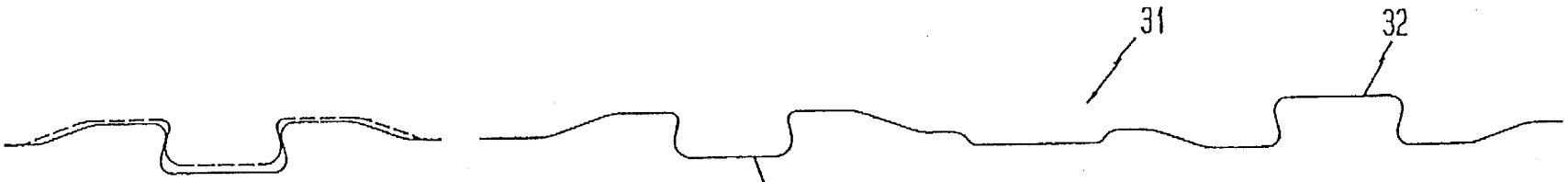

FIG. 20 a detail of a locking mechanism of the cover with corresponding wall panel or cover, which is placed on top, FIG. 21 a detail X from FIG. 19 to show a special embodiment of tabs and recesses 14 and 15, FIG. 22 a view of the narrow side of the cover in FIG. 18, FIG. 23 a detail of the knob (protuberance) fields provided at the bottom of the cover, FIG. 24 a top view of the partial elements which are mountable onto a collapsible wall panel, FIG. 25 a side view of half a partial element, which forms the longitudinal side of a collapsible wall panel, FIG. 26 the view according to FIG. 25 seen from above, FIG. 27 a side view of the longitudinally running partial element represented in FIG. 24 (cf. also shown in FIG. 25), FIG. 28 a side view of the short partial element according to FIG. 24, FIG. 29 the detail of the locking mechanism of the longitudinal side of the wall panel according to FIG. 27 as well as FIG. 30 a side view of the short side of the wall panel or of the corresponding partial element according to FIG. 24.

In FIGS. 1 to 4, an element is shown which can equally serve as bottom and cover of the container, which can be assembled into a container together with a wall panel shown in FIGS. 5 to 7. Specifically, a container can be formed from the element shown in FIGS. 1 to 4 by an element shown in FIG. 1 to 4 as bottom, a wall panel that can be placed on top of the latter according to FIGS. 5 to 7 and a cover placed on top of the upper end of the wall panel.

The element according to FIGS. 1 to 4, hereinafter designated as bottom (or equally as cover, however), is a plate-like bottom element 1 with an all-around wall molding 2, which projects slightly upward from the bottom surface and which also without the mounted wall panel provides a lateral hold to the goods placed on the bottom. The height of the wall molding, measured from the underside of bottom element 1, preferably amounts to between 30 and 45 mm, especially preferred is 37.5 mm. Wall molding 2 is indented at its lower end at 2*a*, so that for the return trip the elements, which form the bottom cover, can be stacked into one another. Indentation 2*a* also serves as gripping aid, thereby facilitating at the same time the handling of the container, which is built up from the element generally designated as 3, as bottom and cover and from wall panel 8. Finally, element 3 which in the embodiment example is provided with a recess 4 at the narrow side, which forms an open slot in the closed container for ventilation and cooling, a well as a gripping surface for handling the container or element 3. At the bottom side 5 of element 3, which is specifically shown in FIG. 1, knob fields are found designated as 6, which assure a slide slowdown or slip resistance when stacking the containers under one another, but also when stacking the containers in conjunction with other packs, such as cartons. In the embodiment example shown, each half of the bottom side 5 is provided with four knob fields, i.e. in total eight knob fields 6. This distribution has been selected in this manner, since it assures the ideal slip slow-down both for vertical stacking of the containers and for transfer stacking. The knob fields consist of a number of rows or protuberances, whereby the consecutive rows are arranged staggered in relation to one another. The knobs themselves are preferably shaped in semicircular fashion. It has been shown that this arrangement of knob fields and this protuberance shape is particularly suitable for the goal of achieving slip resistance.

To strengthen element 3, vertically oriented reinforcement fins 7 are provided in the inside area of wall moldings 2. The wall areas of the module, however, can also be concave shaped or with concave profiles. Reinforcing seams are also possible.

These elements 3 which are visualized as bottom and cover may be combined with wall panel 8 appearing in FIGS. 5 to 7, which forms the side walls of the container. This wall panel 8 is of collapsible construction, whereby in the corner areas of the wall panel, preferably slightly offset in the longitudinal areas of the wall panel, hinges have been provided. In the embodiment example shown and especially preferred are two diametrically opposing joints 9 forming hinge joints and two other opposing joints are "film" hinges 10, roughly at the narrowed down corner areas of the wall panel. By means of slanting surfaces 11, film hinges 10 take on the latch function of the panel in folded out position, which leads to a release of hinge joints 9 during swing-out. If needed, film hinges or also hinge joints can be used at all four corners. Particularly suitable is a hinge with two joint fingers which are interspaced and between which a joint latchet assures the grip, whereby the three joint constructions are connected together to the hinge joint through a hinge pin.

Film hinge 10 of a slimmed down film hinge-type material preferably stretching out over the entire height of the wall panel, has the advantage that basically over the entire height of wall panel 8 tensile stresses are absorbed over a very large surface, which is of importance for the useful life of wall panel 8. Slanted surfaces 11 (FIG. 5) serving as buffer surfaces or stops are arranged inclined preferably at 45° with respect to the main surfaces of wall panel 8. The height of wall panel 8 lies suitably in the area of 65 to 85 mm preferably at 75 mm, whereby module-type wall panel gradations can be provided, like 150 mm high wall panel modules and 75 mm wall panel modules.

To form the container, reciprocal attachment of individual elements 3 and 8 occurs by means of interchangeably arranged tabs and recesses which are arranged opposite to one another in accordance with the interchangeably arranged tabs and recesses of the counterpart. In this way, element 3 forming the bottom or the cover of the container has tabs 12 and recesses 13 at the two opposing longitudinal sides, whereby tabs 12 project upward beyond an upper border surface of wall molding 2 of element 3. Tabs 12 on the one longitudinal side of element 3 are hereby directly facing corresponding recesses 13 at the other longitudinal side. Tabs 14 at both opposing narrow sides of element 3 are constructed cog-shaped, so that recesses 15 are also formed complementarily. Also here, tabs 14 and 15 are arranged opposite to one another in interchangeable position. As may be observed clearly from FIG. 2, tabs and recesses 12, 14 and 13, 15 are arranged offset toward the outside and thereby away from the inner perimeter of wall molding 2 offset toward the outside of the wall molding. This assures that projecting tabs 12 do not interfere when several elements 3 are stacked into one another, since otherwise corresponding recesses would have to be provided in the outside area of element 3, which would also lead to a weakening of the structure of elements 3. Tabs 12, 14 possess hereby at the inward facing side a conical surface, which is clearly evident from FIGS. 3 and 4. Naturally, instead of the embodiment forms of the tabs and recesses shown, also other suitable profile forms are applied. Using two tabs and two recesses at each side of element 3 has been proven to be effective. It goes without saying that pertinent tabs and recesses of the module have appropriate lengths when producing a plug-in connection, whereby snap-in connections may also be effectively created.

Similarly in interchangeable arrangement, wall panel 8 contains complementary tabs and recesses, so that elements 3 and 8 can be stacked on top of one another at random. From the description follows clearly, that to produce a container also a random number of wall panels can be placed on a bottom element. As appears from FIG. 6 and 7, corresponding knob fields 6 are arranged on the external surfaces of wall panel 8, whereby on the longitudinal side of the wall panel each times four and on the narrow side each times two of knob fields 6 are provided. Also the tabs and recesses of wall panel 8 are designated with the same reference marks as element 3. Finally, FIG. 7 shows quite clearly on the right the hinge of two spaced out fingers 16 and a hinge tab 17 gripping between the fingers. Finally, the inner surfaces of wall panel 8 are also effectively strengthened with reinforcement fins 7.

Elements 3 and 8 are appropriately manufactured from the same plastic, i.e. preferably from shock resistant polypropylene. To affix the elements assembled into the container, tightening straps are preferably used, which are pulled around the container and soldered, if necessary. Also these straps are suitably made of polypropylene, i.e. from the same material as elements 3 and 8. For the physical positioning of the tightening straps corresponding recesses are provided in the external surfaces of elements 3 and 4, which are designated by 18. This assures an even, optically pleasing but also positive interlock seating of the fastener.

As surface measurement for module or container every dimension is suitable, which enables a sensible arrangement of the containers on standard pallets. Preferred dimensions are 300×200 for outside and 280×185 mm for inside; but also suitable are dimensions from 400×300 for outside and 370×280 mm for inside. Of course, further variations are possible; especially regular gradations are preferred in the wall height of the modules.

In order to increase the stability and to decrease the weight, it is furthermore appropriate to create the wall moldings and wall panels with concave spaces, whereby the concave space construction is carried out suitably by means of the press molding process.

Collapsing the wall panel occurs by pressing the panel together at an angle, thus lining up one longitudinal side and one narrow side on a plane, so that two adjoining wall surfaces are created with each one narrow and one longitudinal side in axial alignment.

The container system described is particularly suitable for use in a returnable transport pack system aimed at the following cycles: manufacturer—trade, wholesale trade—retail trade, trade—service provider and trade—consumer. In the manufacturer—trade cycle, volume and weight are preferably recorded, rather than the number of containers which have been made available. The manufacturer supplies the trade with a predetermined quantity of containers and guarantees to take the containers back. Following disposal by the trade, the volume of containers disposed of is weighed and the weights at arrival and departure are compared. The trade is thereby permitted a loss quota.

In the wholesale—retail trade cycle, recording of the delivery by the industrial entity also occurs via volume and weight, similarly for passing the pack on from wholesale to retail level. Pickup at the retail level occurs via a service provider after the corresponding weight control has been carried out. The service provider arranges disposal for the trade while recording the weight either at the trade level or at delivery to the service provider. Task of the service provider is sorting, washing, storing and financing the container systems following pickup from the trade and prior to delivery to the manufacturer, thus completing the cycle of returnable transport pack system.

In the traffic with the consumer, it is appropriate to provide for a deposit system for the containers with flat-fee deposit amounts, in order to reduce possible losses. It is thereby useful, especially considering the theft risk, to introduce a chip system, so that a deposit reimbursement only occurs then, when the RTS (returnable transport system) containers are returned together with the chip. In connection with this new, hereby equally claimed system, the use of the container described above is extraordinarily effective or such a system can be produced in a particularly effective manner using the container described above.

In FIGS. 8 to 16, a further embodiment is shown of a wall panel which is compatible with the remaining elements, for which the same reference marks are being used for identical components. Also this wall panel according to FIG. 8 has two diametrically opposing hinge joints 9 and two diametrically opposing film hinges 10; however, it is preferably assembled from two identical partial elements that are separable and can be mounted onto the wall panel. One of the partial elements is shown in FIG. 9 in stretched out position, from which film hinge 10 is clearly visible. From FIGS. 9 and 10 as well as from FIGS. 12 and 13, the hinge joint is also clearly visible, whereby at one end of the partial element at one fork joint 19 two seats 20 are provided for hinge pins 21 shown at the other end of the partial element. At hinge pin unit 22, a clip tab 23 is also constructed, which in fold-in position snaps into a corresponding recess 24 on fork joint 19 of the other partial element to form the wall panel according to FIG. 8. The fork joint seat is best observed from the detail in FIG. 13. From this, it is evident in particular that pins 21 can be effectively pushed into seats 20 by means of a slot channel 25, so that they seat firmly in fork joint 19, but can still be loosened (cf. FIG. 13).

From the views in FIGS. 15 and 16, it it evident that at the outside of this wall panel 8, fins 26 which are running longitudinally and parallel to each ocher have been constructed in the form of a ribbon of fins, whose profile form appears from FIG. 17, and which serve to improve installation and removal of labels used for the containers at the site, i.e. on the store shelf. Based on this fin structure, the labels can be removed and new ones installed very easily, especially when the same container is being displayed on the store shelf with different merchandise.

In FIG. 18 and subsequent figures, a further embodiment form is shown consisting of bottom, cover and wall panel, especially for large containers, having cross-section dimensions of approx. 400×600 mm and larger. In order to increase the rigidity of the bottom and/or cover elements, they are constructed with dual walls, as appears from FIGS. 19 and 22. The dual wall construction is achieved by means of extrusion blowing. In order to assure an exact distance between both walls 28 and 29, from the top 27 on—at the upper part of the bottom of the cover marked 27—cup-like or tube-like formations 30 are molded in one piece, which are effectively constructed at regular distances, especially in parallel rows over the cross-section of the cover and the bottom. These cup-like or tube-like formations 30, however, do not only assure the distance between both walls of the concave cover, but through them the rigidity of the cover or of the bottom is being increased. At the external surface of cover and bottom, just like in the wall panel described below, fins 26 are constructed, which are arranged to run longitudinally and parallel and which correspond to the fins according to FIGS. 16 and 17. The narrowly spaced fins arranged next to each other are visible. Moreover, the construction of the cover and/or bottom resembles the above described elements, so that for identical building blocks the same references marks are used. An essential deviation in relation to the above described embodiment examples, however, consists in a locking mechanism 31, which is shown in FIGS. 19 and 20. Specifically involved are undercut slots 32 and corresponding projections 33, which are constructed to complement each other, so that during assembly of a cover with an additional bottom or cover or wall panel the corresponding slots and projections can snap-lock in place. This results in a certain hold and a certain affixing of the individual elements for constructing a container and loosening is only possible by exerting a certain pressure. For absolute attachment of the container elements to a container, additional fasteners are suitably used, such as the tightening straps described before which can be soldered and subsequently loosened by simply tearing them apart, and which are seated flush especially in corresponding recesses 18 of the elements. Based on the concave construction of cover and bottom, inner fins 7 provided for the other embodiment forms can be dropped. As shown in FIG. 19, recesses 18 are provided for seating the tightening straps also at the upper edge and not only on the outside.

In FIG. 24 another wall panel 8 that can be folded together, is shown, for which the same reference marks are being used for the same components. Wall panel 8 is assembled according to FIG. 24 from two partial elements 34 forming the narrow side and two partial elements 35 forming the longitudinal side, whereby in FIG. 24 only one longitudinally running partial element 35 is shown. The wall panel consists of four partial elements 34 and 35, whereby in the corner areas hinge joints are each time arranged similar to the above described construction. The construction details of the hinge joints appears from the drawings.

Essential in the case of the hinge joints is that the hinges do not seat directly in the corner, but are offset by a certain dimension A, as appears from FIG. 24, so that the axle joint is seated away from the immediate corner, apparoximately on the longitudinal side. This is advantageous, because in this way when folded together, the largest dimension is formed by the length of longitudinal partial element 35, given the fact that leg joints 36 which protrude at the ends on the shorter partial element are situated inward when folding together and do not project outward beyond partial elements 35. Additionally, in the center of short partial elements 34 a film hinge has been constructed similar to film hinge 10, so that, as appears from FIG. 24 on the right, partial elements 34 can be folded or collapsed inward. In collapsed position, partial elements 34 do therefore not project beyond partial elements 35.

Locking mechanism 31 shown in FIGS. 27 and 29, corresponds to the locking mechanism on above described cover, so that no further explanation is necessary. Furthermore, longitudinal fine 26 are again provided on the external surfaces, as needed. The partial elements or the wall panel can be constructed concave or also with inner fins.

I claim:

1. A reusable, returnable container for shipping and displaying product transported therein, the container assembled from a plurality of separable elements, comprising in combination:

a low profile, tablet-shaped bottom element having a generally central region configured to center and support the product thereon, said central region substantially surrounded by a low profile wall molding;

a wall frame open at opposite ends, and having a height substantially greater than said low profile wall molding, a first end of said wall frame configured to rest on said low profile wall molding to substantially enclose said bottom element and the product supported thereon;

said wall frame constructed from a plurality of pivotally interconnected wall segments and configured to be removed from said bottom element and folded into a substantially collapsed and compact package to permit display of the product supported on said bottom element; and a low-profile, tablet-shaped top element identical in shape and form to said bottom element and configured to rest on and close a second end of said wall frame to substantially enclose and center the product within the container;

wherein said low-profile, tablet-shaped bottom and top elements each have at least two recesses defined at opposite ends in said low profile wall molding for providing grip points on the container as well as partially displaying the product when the container is assembled and being shipped.

2. A returnable plastic container for both shipping and displaying objects, and assembling from separate elements based on two different modular element designs configured to transition between a container and a display, comprising in combination:

a first element usable as a bottom or a top, having a generally central tabular region defined in a first surface, configured to center and support objects thereon, and substantially surrounded by a low profile wall molding having an upper edge, and tapered exterior side walls to permit stacking, a recess defined in at least two opposing wall moldings of said first element usable as a bottom or a top, said recesses defining hand grips and a window for partially displaying product contained within the container when the container is assembled;

a wall frame formed by a plurality of pivotally interconnected wall panels, said wall frame having a height substantially greater than said low profile wall molding, and open at opposite ends, each end configured to rest in butting relationship against said upper edge of each low profile wall molding, said wall frame configured to be removed from said top and bottom and collapse from a first position wherein adjacent wall panels are generally extended to a second position wherein adjacent wall panels are folded generally against each other to expose and display the objects supported on said bottom.

3. A modular, returnable, reusable container for accommodating and displaying products, the container assembled from separable elements of two different designs, comprising in combination:

a wall frame assembly formed by a plurality of wall panels pivotally interconnected to each other to form a wall open at opposite ends, said wall frame adapted to collapse such that adjacent wall panels are substantially parallel to each other;

a low-profile, tablet-shaped bottom and top elements, each having a generally central region defined on one side configured to center and support products thereon, said central region surrounded by a low-profile wall molding substantially smaller in height than said wall frame assembly, an edge of each wall molding configured to engage one end of said wall assembly in butting relationship to substantially surround and enclose product therein; and a recess defined in at least two opposing wall moldings of said top and bottom elements for defining hand grips of at least a hand's breadth and a window for partially displaying product contained within the container when the container is assembled;

wherein the product is enclosed, packaged, and shipped when surrounded by the wall frame assembly and the top and bottom elements, and upon removal of the top element and the wall frame assembly the product may be displayed and removed from the container.

* * * * *

UNITED STATES PATENT AND TRADEMARK OFFICE

CERTIFICATE OF CORRECTION

PATENT NO. : 5,720,410
DATED : FEBRUARY 24, 1998
INVENTOR(S) : HANS UMIKER

It is certified that error appears in the above-identified patent and that said Letters Patent is hereby corrected as shown below:

Column 7, Line 25;
"ocher" should be --other--.

Column 8, Line 25;
"apparoximately" should be --approximately--.

Column 8, Line 41;
"fine" should be --fins--.

Column 9, Claim 2, Line 27;
"butting" should be -abutting--.

Column 10, Claim 3, Line 16;
"butting" should be abutting--.

Signed and Sealed this
Eighth Day of September, 1998

*Attest:*

*Attesting Officer*

Bruce Lehman

BRUCE LEHMAN

*Commissioner of Patents and Trademarks*